US005702153A

United States Patent [19]

Pliska

[11] Patent Number: 5,702,153

[45] Date of Patent: Dec. 30, 1997

[54] TAIL BONE CUSHION

[76] Inventor: Lee Pliska, 76 Roehampton Avenue, Apt. 202, St. Catharines, Ontario, Canada, L2M 7W5

[21] Appl. No.: 678,782

[22] Filed: Jul. 11, 1996

[51] Int. Cl.[6] ..... A47C 7/02

[52] U.S. Cl. ..... 297/256.16; 5/653; 297/452.11; 297/452.22; 297/230.1

[58] Field of Search ..... 5/653, 654, 421, 5/922; 297/452.16, 452.22, 452.46, 284.4, 284.5, 284.7, 256.16, 230.1

[56] References Cited

U.S. PATENT DOCUMENTS

| | | | |
|---|---|---|---|
| 2,734,556 | 2/1956 | Hebrank | 5/653 |
| 3,222,694 | 12/1965 | Schick | 5/653 |
| 3,346,298 | 10/1967 | Champion | 297/452.16 |
| 3,540,776 | 11/1970 | Wilson | 297/284.5 |
| 3,638,255 | 2/1972 | Sterrett | 5/653 |
| 4,164,798 | 8/1979 | Weber | 5/653 |
| 4,824,169 | 4/1989 | Jarrell | 5/653 |
| 4,824,174 | 4/1989 | Dunn, Jr. | 5/653 |
| 5,402,545 | 4/1995 | Jolley | 5/653 |
| 5,572,757 | 11/1996 | O'Sullivan | 5/632 |

FOREIGN PATENT DOCUMENTS

| | | | |
|---|---|---|---|
| 768163 | 8/1934 | France | 297/452.22 |
| 6362 | 5/1894 | United Kingdom | 5/653 |

*Primary Examiner*—Alexander Grosz
*Attorney, Agent, or Firm*—James W. Carson

[57] ABSTRACT

The present invention relates to a tailbone cushion to eliminate discomfort of patients afflicted with hemorrhoids, fissure, damaged coccyges (tailbone) or the like associated with sitting on hard surfaces. The tail bone cushion of the present invention consists of a cushion section having front, rear and side edges and generally flat top and bottom surfaces. The cushion section has a cutout centrally disposed in the rear edge providing said cushion section with a U-shaped configuration. The cutout is sized and located to eliminate contact between the patient's tailbone and either the cushion or the surface underneath the cushion. The cushion section is preferably tapered in thickness and firmness from rear to front. The cushion section is also preferably formed from a casing filled with a material that has low compression under a patient's body weight yet soft enough to permit sitting for extended periods with minimal discomfort. The tail bone cushion is optionally provided with a back support. The back support has top, bottom and side edges and generally flat front and rear surfaces. The back support is preferably detachably connected to the cushion section by a hinged connection between the rear edge of the cushion section and the bottom edge of the back support to permit the tailbone cushion to be folded flat for storage or transport and opened for use. Means may be provided with said back support to provide a lumbar support preferably a hot pack. The means can include a sleeve or pouch located on the front surface of said back support.

4 Claims, 3 Drawing Sheets

TAIL BONE CUSHION

BACKGROUND OF THE INVENTION

1. Field of the Invention

This invention relates to devices for use in connection with back disorders (i.e. subluxation, disintegration of the vertebrae and disc) or anal surgery, as in the case of hemorrhoids, fissure or damaged coccyges (tailbone).

2. Description of the Prior Art

Apparatis are known to assist persons who have back disorders as a result of disintegration of the vertebrae and disc or anal surgery as in the case of hemorrhoids, fissure or damaged tailbones to eliminate, as far as possible, any discomfort affiliated with sitting on hard surfaces. The prior art devices consist of a ring that is inflated (i.e. a small inner tube). These devices fall short of meeting the expectations of the patients who use them. Since they are circular, they experience a number of disadvantages, in that when a patient moves in any direction, left, right, forward or back, they are thrown off balance. Depending on the degree of their disability, the patient may not be able to reposition themselves properly. Moreover there is a tendency for these prior art devices to be pushed out from under the patient by their own body weight if they are not positioned just so or, if they shift their body weight even slightly in any direction, which is virtually impossible to prevent. This is partially because of the materials and method of construction: rubber and/or plastics which are inflated. These materials tend to stretch as they reach body temperature. Thus, a shift in body weight or position will push much of the air to one side of the ring, causing the patient to fall in the opposite direction. This problem is compounded, in that, the above mentioned materials cause considerable discomfort as they may induce sweating or release of body fluids. Due the salt content in the sweat and body fluids burning may occur resulting in increased discomfort in any exposed area of the patient's body. Further compounding the problem excessive sweating makes the material very slippery and difficult to sit on without sliding. This can be particularly bothersome if the patient is wearing shorts or bathing suit. In addition, rubber and plastics, when exposed to the sun can be heated sufficiently to burn sensitive skin that comes into contact with the hot rubber or plastic. Also patients may have difficulty inflating the devices if they are required to blow air into them through a valve. Attempts at solving these problems have to date not been successful.

SUMMARY OF THE INVENTION

It is an object of the invention to provide a device for patients recovering from surgery on hemorrhoids, fissure, damaged coccyges (tailbone) or the like to eliminate discomfort affiliated with sitting on hard surfaces.

It is another object of the invention to provide a device non-collapsible at the rear.

It is a further object of the invention to provide a device with an optional and detachable back support with self contained removable hot pack for relief from lower lumbar problems.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
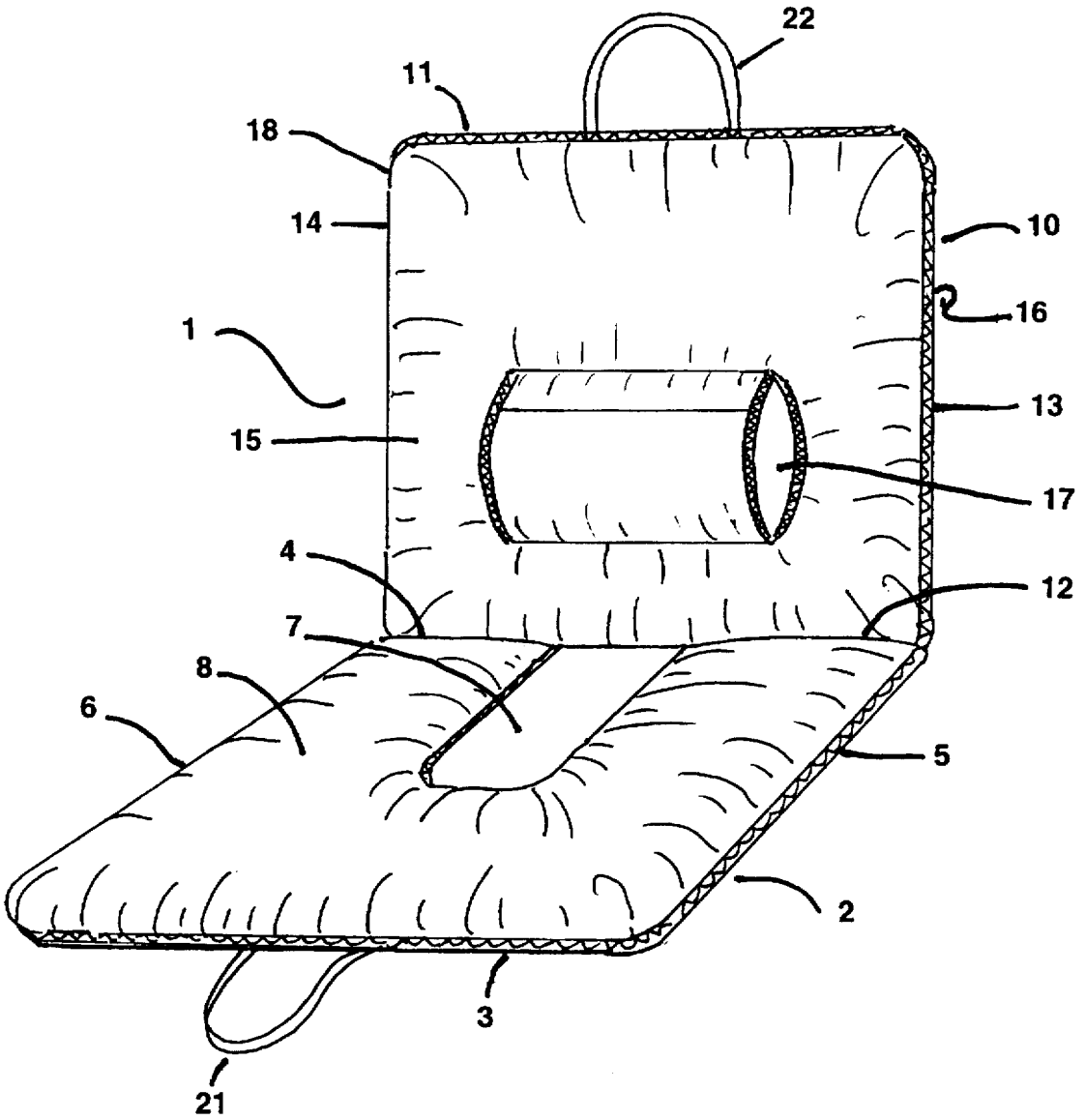
FIG. 1 is a perspective view of a tail bone cushion according to the present invention.
Figure 2:
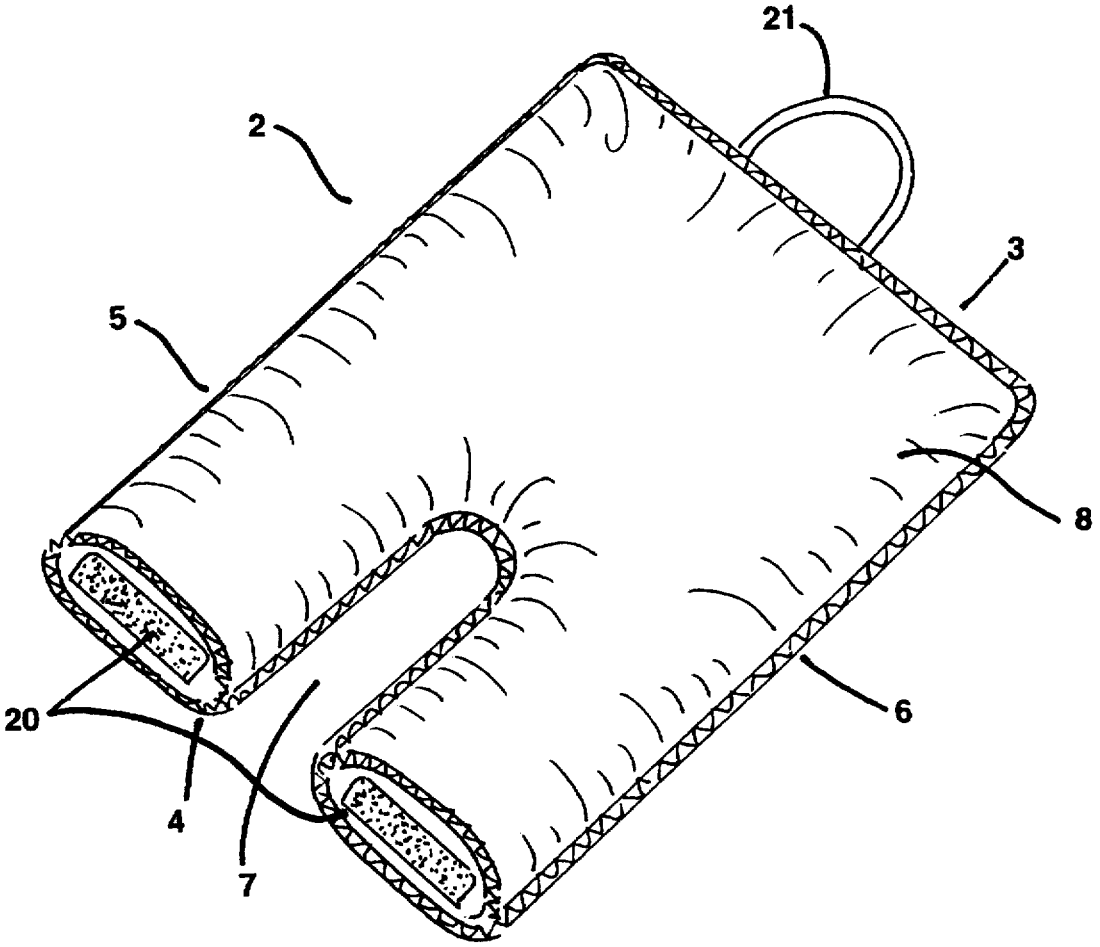
FIG. 2 is a top view of the cushion of FIG. 1.
Figure 3:
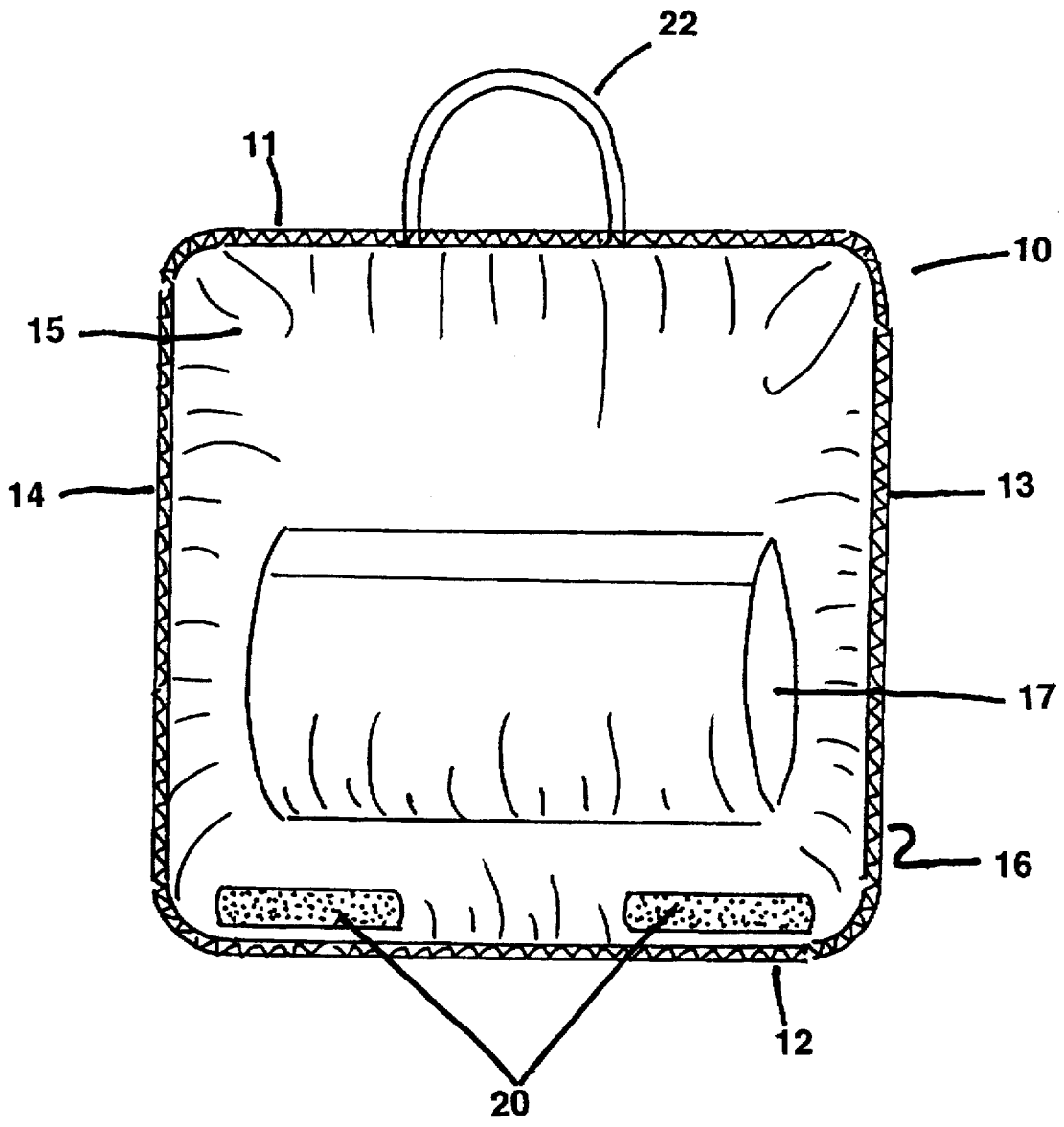
FIG. 3 is a front view of the detachable back support with self contained removable hot pack for the tailbone cushion of FIG. 1

Referring to FIGS. 1 to 3, a tailbone cushion in accordance the present invention is generally indicated at 1. The tailbone cushion 1 comprises a cushion section 2 having front 3, back 4 and side edges 5 and 6 respectively. Cushion section 2 is flat and has a cutout 7 centrally disposed in the rear edge 4 and extending up to half the length of the cushion. The cutout 7 is sized so that a person's tailbone will not make contact with either the cushion or the surface on which the patient is sitting. The cutout 7 provides cushion section 2 with a rearward opening U-shaped configuration. The thickness and firmness of the cushion section 2 is decreased from the rear edge 4 to the front edge 3 so that the cushion section is contoured proportionately to the human body.

The size (length and width) of the cushion section 2 may vary depending on the size, age and weight of the patient but 20"×20" has been found to be suitable for the majority of cases. Cutout 7 is preferably about 8" long by 5" wide. The thickness of cushion section 2 is about 2.5" at the rear edge 4 and tapering to 1.5" at the front edge 3.

The cushion section 2 preferably is formed from a casing 8 which is inserted with packing material that does not collapse under heavy weight yet is soft enough to allow comfort while sitting for extended periods of time. In the preferred embodiment the packing material is a 100% bonded polyester material that is odorless, nonallergenic, mildew and moth proof, resilient and washable. A packing material manufactured by Union Felt Products of Downsview, Ontario under the trademark "the Little Craft Batt" has proven to be suitable. By layering the packing material as it is inserted into casing 8 a generally flat and tapered contour of the cushion section 2 is provided and bunching or separation of the material is eliminated. The casing 8 is made from a material that will not cause sweating when in contact with a patient's skin such as vinyl which is waterproof and non-allergenic. The material is also preferably water repellent and fire resistant. A suitable material can be obtained by Healtex Manufacturing of Toronto, Canada.

The tailbone cushion 1 may optionally be provided with a back support 10 that is preferably removable. The back support 10 has top 11 and bottom 12 edges and side edges 13 and 14 and generally flat front and rear surfaces 15 and 16. The back support 10 is preferably the same size as the cushion section 2. Means is provided to permit back support 10 to contain a lumbar support preferably a hot pack. In the preferred embodiment the means for containing the hot pack is sleeve 17 attached to the front surface 15 of the back support 10. The sleeve 17 permits the hot pack (not shown) to be inserted and removed. The sleeve is positioned on the front surface 15 so that it can provide relief for lower lumbar problems. Alternatively the means for containing the hot pack could be a pouch, restraining straps or the like. The back support 10 is preferably formed from a casing 18 inserted with packing material similar to the cushion section 2.

Means are provided for detachably connecting cushion section 2 and back support 10. This connection means should preferably act as a hinge to permit cushion section 2 and back support 10 to be folded flat for storage or transport and opened to the operative position shown in FIG. 1. (i.e. back support 10 at right or obtuse angle to cushion section 2). In the preferred embodiment the connection means consists of Velcro strips 20 attached to the rear edge of cushion section 2 and the front surface 15 adjacent the bottom edge 14 of back support 10.

Carry means are provided to facilitate transport of the tail bone cushion. In the preferred embodiment the carry means consists of straps 21 and 22 attached to the front edge 3 of cushion section 2 and top edge 11 of back support 10. Other suitable means could be provided without departing from the scope of the present invention.

The tailbone cushion 1 of the present invention is designed to eliminate discomfort of a patient caused when the anal or tailbone area make contact with any surface or fabric. Healing speeds up in the case of surgery on the coccyx (tailbone, hemorrhoids and/or fissure) if the affected area is not in contact with any material and is permitted to breathe.

The present invention eliminates the problems associated with the prior art devices. When a patient sits on the tailbone cushion of the present invention the packing material is not compressed or collapse at the rear under the patient's body weight and does not bulk or separate in any direction. Yet, it is soft enough to allow comfort while sitting for extended periods. This provides a stable and comfortable cushion on which to sit that eliminates contact between the injured area and any material or hard surfaces. Further due to the tapering of the thickness and firmness from rear to front there is no restriction of the patient's circulation in any way. Thus, it eliminates added discomfort that would not otherwise be preventable. Because it is flat and contoured proportionately to the human body it is very comfortable and easy to sit on for extended periods of time.

By virtue of the use of materials of construction sweating and the release of body fluids is eliminated. This prevents burning of sensitive exposed skin and the cushion becoming slippery and difficult for the patient to maintain his or her position.

By providing the optional back support additional relief from lower lumbar problems can be provided. If the patient desires to insert a hot/cold pack it can be heated or cooled as desired and then inserted into the pouch on the back support. If the hot/cold pack loses its effective temperature, the pack can be removed and a new one inserted or the removed one reheated or cooled as the case may be.

The tail bone cushions of the present invention are very light, so light that even an arthritic patient can carry them by the carry straps. The construction materials have been tested for washability with more than favourable results. i.e. when washed and tumble dried the material does not separate, bunch, collapse or shrink.

Having illustrated and described a preferred embodiment of the invention and certain possible modifications thereto, it should be apparent to those of ordinary skill in the art that the invention permits of further modification in arrangement and detail. All such modifications are covered by the scope of the invention.

The embodiments of the invention in which an exclusive property or privilege is claimed are defined as follows:

1. A tailbone cushion to eliminate discomfort of elderly or infirm patients afflicted with hemorrhoids, fissure, damaged coccyges (tailbone) or the like associated with sitting on hard surfaces for long periods, said tailbone cushion consisting of a cushion section having front, rear and side edges and tapered in thickness and firmness from the rear edge to the front edge, a cutout centrally disposed in the rear edge of said cushion section providing said cushion section with a U-shaped configuration; said cutout being sized and located to eliminate contact between the patient's tailbone and the cushion and the surface underneath the cushion, wherein said cushion section is formed from a waterproof and non-allergenic casing that will not cause sweating when in contact with a patient's skin, said casing filled with a layered odorless, non-allergenic, and resilient bonded polyester material that has low compression under a patient's body weight yet soft enough to permit sitting for extended periods with minimal discomfort, said tailbone cushion further including a back support hingedly connected to the said cushion section, whereby the tailbone cushion can be folded flat for storage and transport, said back support including a sleeve or pouch located on the front surface thereof, said sleeve or pouch adapted to removably retain a lower lumbar support or a hot or cold pack.

2. A tailbone cushion according to claim 1, wherein the back support has a top, bottom and side edges, and a generally flat front and rear surface.

3. A tailbone cushion according to claim 1 wherein connection means are provided for detachably connecting said back support to the cushion section.

4. A tailbone cushion according to claim 1 wherein the casing is fabricated from vinyl.

* * * * *